United States Patent [19]

Tsukahara et al.

[11] Patent Number: 4,481,921

[45] Date of Patent: Nov. 13, 1984

[54] FUEL INJECTION APPARATUS OF INTERNAL COMBUSTION ENGINE

[75] Inventors: Kenji Tsukahara; Kouji Mutsukura; Takayoshi Inoue, all of Aichi, Japan

[73] Assignee: Nippondenso Co., Ltd., Kariya, Japan

[21] Appl. No.: 496,215

[22] Filed: May 19, 1983

[30] Foreign Application Priority Data

| | | | |
|---|---|---|---|
| May 26, 1982 | [JP] | Japan | 57-89352 |
| May 26, 1982 | [JP] | Japan | 57-89353 |
| May 26, 1982 | [JP] | Japan | 57-89354 |
| May 26, 1982 | [JP] | Japan | 57-89355 |

[51] Int. Cl.[3] ..... F02B 3/00

[52] U.S. Cl. ..... 123/304; 123/300; 123/575

[58] Field of Search ..... 123/304, 575, 299, 300

[56] References Cited

U.S. PATENT DOCUMENTS

| | | | |
|---|---|---|---|
| 1,101,271 | 6/1914 | Gentzen | 123/575 |
| 1,180,169 | 4/1916 | Marhenke | 123/575 |
| 1,238,828 | 9/1917 | Schenker | 123/575 |
| 1,419,231 | 6/1922 | Crossley | 123/304 |
| 2,947,291 | 8/1960 | Klinge | 123/575 |
| 3,216,407 | 11/1965 | Eyzat | 123/299 |
| 3,308,794 | 3/1967 | Bailey | 123/575 |
| 3,749,097 | 7/1973 | Grow | 123/304 |

FOREIGN PATENT DOCUMENTS

| | | | |
|---|---|---|---|
| 90562 | 6/1920 | Switzerland | 123/575 |
| 116427 | 6/1925 | Switzerland | 123/575 |

*Primary Examiner*—Ronald B. Cox

*Attorney, Agent, or Firm*—Cushman, Darby & Cushman

[57] ABSTRACT

A fuel injection apparatus for an internal combustion engine arranged so as to inject different types of fuel in a given order has fuel injection nozzles respectively corresponding to cylinders of the internal combustion engine, compressors for respectively delivering an auxiliary fuel to the fuel injection nozzles, and a main fuel injection pump for compressing and delivering a main fuel to the fuel injection nozzles at respective given timings. Each fuel injection nozzle has a fuel reservoir around the distal end portion of a nozzle needle in the vicinity of a fuel injection port. The auxiliary fuel from the corresponding compressor is delivered to a portion of the fuel reservoir which is adjacent to the fuel injection port. A second passage is formed to receive the auxiliary fuel from a portion of the fuel reservoir which is adjacent to the fuel injection port. A first passage is formed to communicate with a portion of the fuel reservoir which is spaced apart from the fuel injection port. The first passage receives the main fuel from the fuel reservoir.

12 Claims, 9 Drawing Figures

FUEL INJECTION APPARATUS OF INTERNAL COMBUSTION ENGINE

BACKGROUND OF THE INVENTION

The present invention relates to a fuel injection apparatus of an internal combustion engine and, more particularly, to a fuel injection apparatus of a diesel engine which controls to effectively supply heterogeneous liquid fuel, such as an auxiliary fuel, which has good ignitibility with respect to a main fuel having poor ignitibility.

In the case of injecting two types of fuel in a diesel engine, alcohol is used as the main fuel and light oil is used as the auxiliary fuel. It has been proposed to add light oil having good ignitibility to alcohol having poor ignitibility, and to inject a mixture thereof into a cylinder. However, it is known that in consideration of its ignitibility such a mixture has a limited mixing ratio. Therefore, when two different types of fuel are used, the main fuel and auxiliary fuel must not be mixed with each other. For example, light oil and alcohol must be separately injected into the cylinder. Alternatively, light oil having good ignitibility is first injected into the cylinder, and alcohol having poor ignitibility is then injected thereinto so as to form a two-layer structure.

Conventionally, means for injecting two different types of fuel are used as indicated by the following items (A) to (C):

(A) two injection pumps are used for the main fuel and the auxiliary fuel, respectively;

(B) the negative pressure of a delivery valve is utilized; and (C) the pulsating effect of the injection system is utilized.

The fuel injecting means in item (A) comprises two sets of injection pumps and corresponding nozzles for the two types of fuel, respectively. Various reports have been made concerning use of the above-mentioned means in a variety of applications. The fuel injection means of this type requires two fuel injection control systems for each cylinder.

An example of the fuel injection means described in item (B) is disclosed in Japanese Patent Publication No. 51-13806. An auxiliary fuel source is connected at an arbitrary position of a path extending from the delivery valve of a main fuel injection system to an injection nozzle through a check valve. The auxiliary fuel is supplied by the negative pressure of the delivery valve to the fuel injection system through the check valve, thereby injecting the main fuel together with the auxiliary fuel from the injection nozzle.

However, in principle, in a fuel injection means utilizing the negative pressure of the delivery valve, a retraction or unloading amount must be increased. Therefore, the cavitation factor is increased degrading durability. The cavitation formed in the injection system due to retraction (i.e., the inlet amount of auxiliary fuel) varies irregularly in accordance with the driving speed and the load. As a result, it is impossible to properly control the inlet quantity of auxiliary fuel.

An example of the fuel injection means described in item (C) is disclosed in Japanese Patent Publication No. 50-23455. According to this fuel injection means, two injection nozzles are disposed for each cylinder. One of the injection nozzles is connected to a fuel pump, and the other thereof is connected to a water tank and a piston operated by the force of fuel compressed and supplied by the fuel pump. Water is sprayed to decrease the combustion temperature of the combustion chamber. The fuel injection means of this type becomes complicated, resulting in inconvenience.

SUMMARY OF THE INVENTION

It is an object of the present invention to provide a simple fuel injection apparatus for an internal combustion engine arranged so as to inject two types of fuel (i.e., main fuel and auxiliary fuel) in a two-layer structure in a given order without mixing the two types of fuel.

It is another object of the present invention to inject two types of fuel from a single injection nozzle in a given order.

It is still another object of the present invention to inject the auxiliary fuel which has good ignitibility before injecting the main fuel, thereby obtaining a good ignition condition in a combustion chamber.

It is still another object of the present invention to properly inject a predetermined amount of auxiliary fuel into a combustion chamber before the main fuel is injected into the combustion chamber, thereby obtaining a stable ignition condition.

In the fuel injection apparatus for an internal combustion engine according to the present invention, a fuel reservoir is formed around a tapered surface of a nozzle needle of each fuel injection valve so as to be adjacent to a surface of a seat formed integrally with the tapered portion. A first fuel as an auxiliary fuel is filled into the fuel reservoir from the direction of the seat. A second fuel as a main fuel is compressed and supplied so as to apply a force to the first fuel and to inject it from the nozzle. The pressure of the second fuel causes the nozzle needle to be driven, so that the nozzle needle first injects the first fuel and thereafter injects the second fuel from the same nozzle.

According to the fuel injection apparatus of this type, a simple fuel injection valve is provided which has only one nozzle for injecting two types of fuel (e.g., light oil and alcohol) therefrom without mixing them and in the order named.

Furthermore, in a compressor for supplying light oil (first fuel) to the fuel reservoir of the injection valve, the corresponding piston is driven using the pressure of the alcohol (second fuel) so as to inject the light oil by means of the piston. As a result, a proper amount of light oil is always injected, thereby obtaining a stable ignition condition and hence stable operation of the internal combustion engine.

DETAILED DESCRIPTION OF THE PREFERRED EMBODIMENTS

Figure 1:
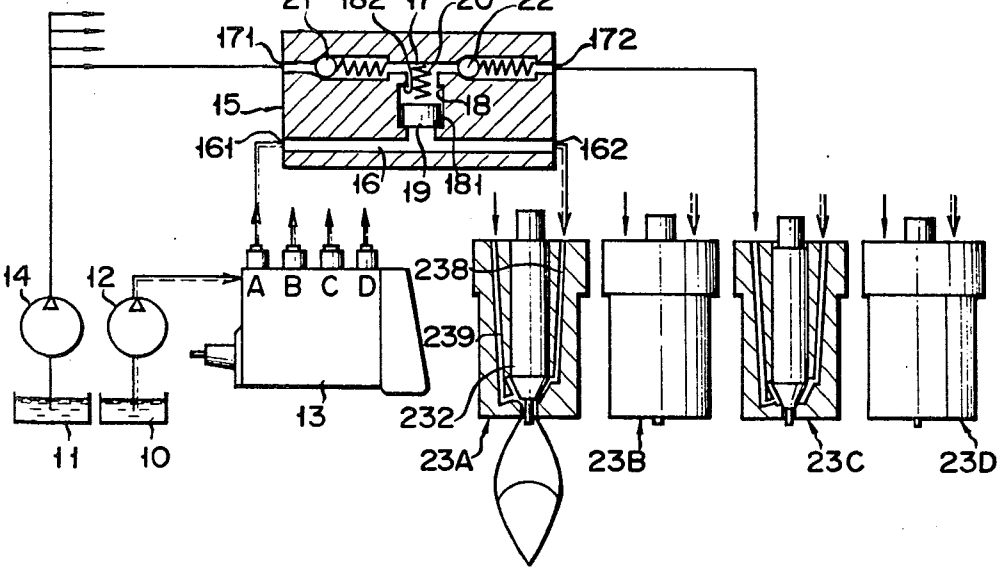
FIG. 1 is a schematic view of a fuel injection apparatus for a 4-cycle engine according to a first embodiment of the present invention.

FIG. 1 shows a fuel injection apparatus according to a first embodiment of the present invention. This fuel injection apparatus is applied to a diesel engine and uses alcohol as a main fuel and light oil as an auxiliary fuel having good ignitibility.

The fuel injection apparatus has a main tank 10 for storing alcohol and an auxiliary tank 11 for storing light oil as the auxiliary fuel. Alcohol in the main tank 10 is delivered by an oil transfer pump 12 to a main fuel injection pump 13. Similarly, light oil in the auxiliary fuel tank 11 is delivered by an oil transfer pump 14 to auxiliary fuel compressors 15. A conventional fuel injection pump which has delivery ports which correspond in number to the number of cylinders of the internal combustion engine is used as the fuel injection pump 13. In this embodiment, since the fuel injection apparatus is applied to a 4-cycle diesel engine, the fuel injection pump has four delivery ports A, B, C and D. The number of auxiliary fuel compressors 15 must correspond to the number of cylinders of the engine. Only one auxiliary fuel compressor 15 is shown in FIG. 1 for illustrative convenience; other auxiliary fuel compressors 15 are omitted. In fact, light oil delivered by the oil transfer pump 14 is equally distributed to four auxiliary fuel compressors 15.

Each auxiliary fuel compressor 15 has a first path 16 for supplying the main fuel therethrough. An inlet port 161 of the first path 16 is connected to the corresponding delivery port A of the main fuel injection pump 13. The auxiliary fuel compressor 15 also has a second path 17 for delivering the auxiliary fuel therethrough. An inlet port 171 of the path 17 communicates with the oil transfer pump 14 so as to deliver light oil supplied from the oil transfer pump 14 thereto. The first path 16 communicates with the second path 17 through a cylinder 18. The cylinder 18 has small-diameter portions 181 and 182 which are respectively adjacent to the first and second paths 16 and 17. A piston 19 is fitted in a large-diameter portion between the small-diameter portions 181 and 182. The piston 19 is fitted in the cylinder 18 such that it is slidable along the axial direction of the cylinder 18. At the same time, the piston 19 is urged by a spring 20 to be normally in tight contact with the small-diameter portion 181 adjacent to the first path 16.

Check valves 21 and 22 are respectively disposed at positions in the vicinity of the inlet port 171 and an outlet port 172 of the second path 17 for delivering the auxiliary fuel. The check valve 21 is opened by the pressure of light oil supplied by the oil transfer pump 14 so as to introduce light oil into the fuel path 17, thereby preventing retraction of light oil toward the inlet port 171. The check valve 22 prevents the retraction of fuel from the outlet port 172. The check valve 22 is opened when the pressure in the second path 17 is higher than that of the oil transfer pump 14, so as to deliver light oil from the second path 17 through the outlet port 172.

When alcohol is compressed and delivered by the main fuel injection pump 13 while light oil is filled in the second path 17, the piston 19 is moved against the urging force of the spring 20 and abuts against the small-diameter portion 182 of the cylinder 18, so that light oil in the cylinder 18 is delivered to the second path 17. Therefore, the check valve 22 is opened and a predetermined amount of light oil which corresponds to the piston stroke is delivered through the check valve 22. When alcohol is neither compressed nor delivered to the first path 16 any longer, the piston 19 is urged by the spring 20 to abut against the small-diameter portion 181 so as to open the check valve 21. As a result, light oil supplied by the oil transfer pump 14 is filled into the second path 17 which includes the space of the cylinder 18. In other words, every time alcohol is delivered from the main fuel injection pump 13, light oil is measured in an amount corresponding to the piston stroke in the cylinder 18 and is delivered by the compressor 15.

Four fuel injection nozzles 23A, 23B, 23C and 23D are disposed in the 4-cycle engine. The fuel injection nozzles 23A, 23B, 23C and 23D correspond to the four delivery ports A, B, C and D of the main fuel injection pump 13, respectively. The alcohol from the delivery port A is delivered to the fuel injection nozzle 23A through the first path 16 of the auxiliary fuel compressor 15 corresponding to the delivery port A.

Figure 2:
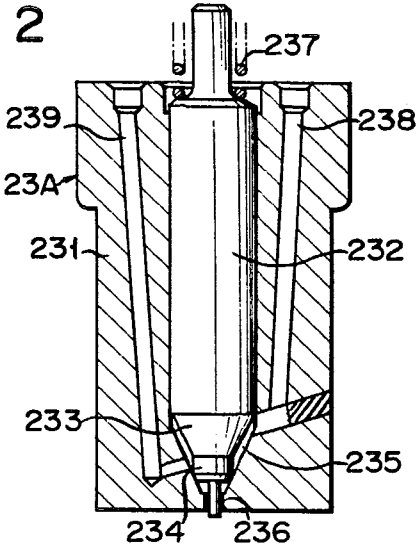
FIG. 2 is a sectional view of a fuel injection nozzle of the fuel injection apparatus shown in FIG. 1.

The fuel injection nozzles 23A to 23D have the same construction, so that the inner structure thereof is exemplified by the fuel injection nozzles 23A and 23C. FIG. 2 shows the detailed inner structure of the fuel injection nozzle 23A. The fuel injection nozzle 23A has a columnar nozzle needle 232 movable along the axial direction of a nozzle housing 231. The distal end portion of the nozzle needle 232 is constituted by a tapered portion 233. The distal end portion of the tapered portion 233 is constituted by a collar-like valve seat 234. A fuel reservoir 235 is formed around the tapered portion 233 integrally with an insertion port of the nozzle needle 232. The fuel reservoir 235 communicates with an injection port 236 through the portion of the housing which is in contact with the seat 234. In this case, the nozzle needle 232 is urged by a spring 237 such that the seat 234 tightly contacts the corresponding housing portion which is integral with another housing portion defining the injection port 236.

First and second passages 238 and 239 are formed in the housing 231. The first passage 238 communicates with the outlet port 162 of the first path 16 of the auxiliary fuel compressor 15, and the second passage 239 communicates with the second path 17 to receive light oil from another compressor corresponding to the fuel injection nozzle 23B. The first and second passages 238 and 239 are respectively open to openings formed above the injection port 236 of the fuel reservoir 235 so as to communicate with the upper portion of the fuel reservoir 235 and with the lower portion thereof in the vicinity of the seat 234, respectively.

When a predetermined amount of light oil is supplied to the second passage 239 of the housing of the fuel injection nozzle 23A, light oil is filled into the fuel reservoir 235 from its lower portion. In this case, alcohol supplied in the previous injection still remains in the fuel reservoir 235. However, the residual alcohol fuel is forcibly discharged to the first passage 238. As a result, only light oil is filled in the fuel reservoir 235 in the space around the seat 234. In this case, the spring 237 has an urging force corresponding to the pressure of light oil, so that the nozzle needle 232 is not driven. When alcohol is compressed and delivered to the first passage 238 while light oil is filled in the fuel reservoir 235, the pressure of alcohol is applied to the tapered portion 233 of the nozzle needle 232, so that the nozzle needle 232 is driven against the urging force of the spring 237. The seat 234 is separated from the corresponding housing portion, so that light oil in the fuel reservoir 235 is injected from the fuel injection port 236. The alcohol in the fuel reservoir is injected immediately after the light oil is injected.

Then, light oil having good ignitibility is first injected into the corresponding cylinder, and then alcohol is injected. These two types of fuel are not mixed with each other but are injected in a predetermined order with reference to time. Therefore, proper fuel injection-/ignition control is smoothly performed in the engine which uses alcohol as the main fuel having poor ignitibility.

The main fuel is supplied from the delivery ports A to D respectively of the main fuel injection pump 13 to the four fuel compressors 15. The main fuel is then supplied from the first paths of the four fuel compressors respectively to the first passages 238 of the fuel injection nozzles 23A to 23D. Each fuel injection nozzle which receives the main fuel performs fuel injection. Meanwhile, the auxiliary fuel is compressed and delivered from different auxiliary fuel compressors from the main fuel compressors before fuel injection is performed. The auxiliary fuel from the compressor 15 which receives the main fuel from the delivery port A is supplied to a different fuel injection nozzle (e.g., fuel injection nozzle 23C).

Figure 3:
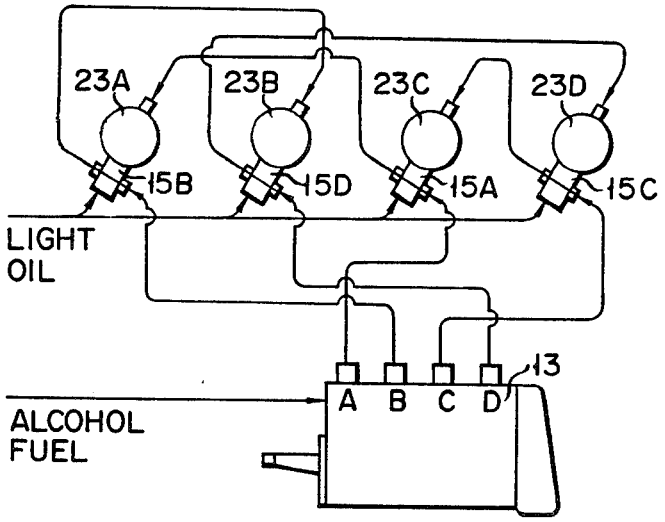
FIG. 3 is a diagram of fuel supply piping when the fuel injection apparatus (FIG. 1) is used in a 4-cylinder engine.

FIG. 3 shows the relationships among the four fuel injection nozzles 23A to 23D, the main fuel injection pump 13, and compressors 15A to 15D which receive the alcohol fuel from the delivery ports A to D respectively of the main fuel injection pump 13. Assume that an order of A, C, D, B is a fuel injection order for injecting the fuel into the four cylinders respectively corresponding to the four delivery ports A to D. Alcohol from the delivery port A of the main fuel injection pump 13 is supplied to the compressor 15A which then compresses and delivers light oil to the fuel injection nozzle 23C. Furthermore, alcohol from the compressor 15A is then supplied to the fuel injection nozzle 23A which then injects light oil therefrom. Alcohol from the delivery port B is supplied to the compressor 15B which compresses and delivers light oil to the fuel injection nozzle 23A which then injects light oil therefrom. Similarly, alcohol from the delivery ports C and D is supplied to the compressors 15C and 15D, respectively, which compress and deliver light oil to the fuel injection nozzles 23D and 23B, respectively. Alcohol from the delivery ports C and D is supplied to the fuel injection nozzles 23C and 23D, respectively.

Figure 4:
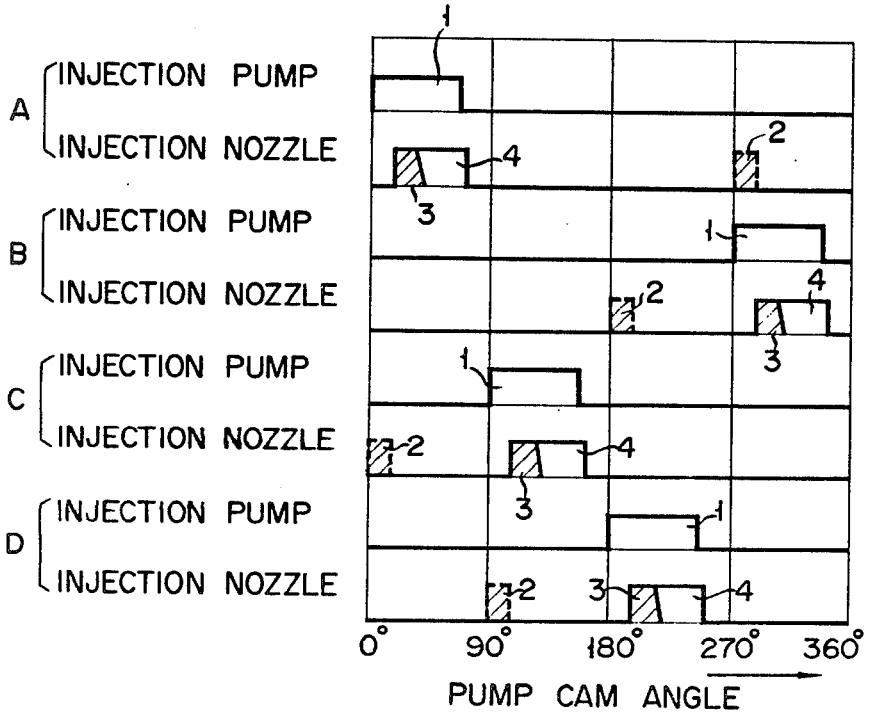
FIG. 4 is a chart for explaining the fuel supply/injection process of the 4-cylinder engine shown in FIG. 3.

FIG. 4 shows the relationships among the delivery state of alcohol from the delivery ports A, B, C and D, the filling state of light oil as the auxiliary fuel to the fuel injection nozzles, and the injection state of light oil and of alcohol, as a function of an angle of a cam for driving the main fuel injection pump 13. In this case, the pump cam is rotated through 360° with respect to two strokes of each piston. The cam angle of 0° corresponds to a delivery start point from the delivery port A of the main fuel injection pump 13. Referring to FIG. 4, reference numeral 1 denotes an alcohol delivery period; 2, a light oil filling period; 3, a light oil injection period; and 4, an alcohol injection period.

Figure 5:
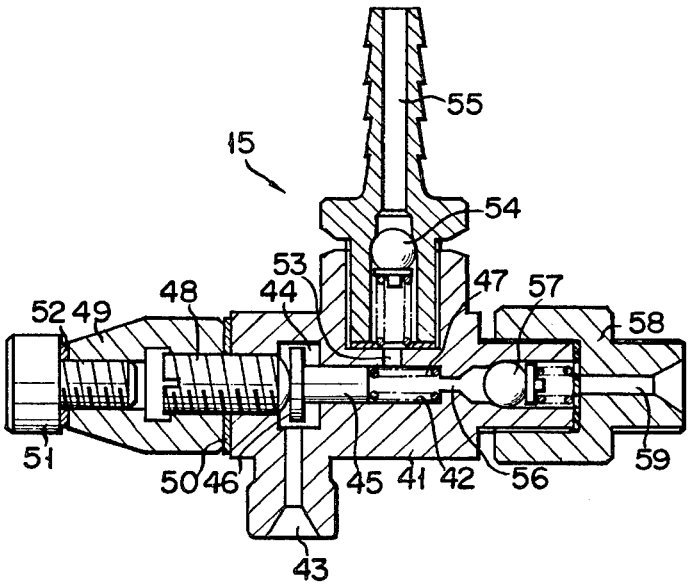
FIG. 5 is a sectional view of a fuel compressor in a fuel injection apparatus according to a second embodiment of the present invention.

FIG. 5 shows a compressor 15 used for a fuel injection apparatus according to a second embodiment of the present invention. A cylinder 42 is defined in a housing 41. A pressure chamber 44 is formed at one side of the cylinder 42 so as to communicate with an inlet port 43 which receives pressurized alcohol from a fuel injection pump (not shown). A piston 45 is inserted in the cylinder 42 from the side of the pressure chamber 44. A collar 46 is formed integrally with the piston 45 in the pressure chamber 44. The piston 45 is movable until the collar 46 abuts against the inlet port of the cylinder 42. A spring 47 is disposed in the cylinder 42 to urge the piston 45 to the left (FIG. 5).

An adjusting screw 48 is partially disposed in the pressure chamber 44 of the housing 41 such that the distal end of the screw 48 abuts against the collar 46 of the piston 45. In this manner, the stop position of the piston urged by the spring 47 is preset by the screw 48. In other words, the stroke of the piston 45 is set by the screw 48. A nut 49 is screwed from the outside of the housing 41 onto the screw 48. When the nut 49 is turned, the adjusting screw 48 is moved and fixed at the predetermined position. In this case, a seal 50 is sandwiched between the nut 49 and the housing 41. Furthermore, another screw 51 is screwed into the opening of the nut 49, and another seal 52 is sandwiched between the screw 51 and the nut 49, thereby achieving the air-tight structure of the pressure chamber 44.

A first path 53 is formed in the side wall of the housing 41 so as to communicate with the cylinder 42. A check valve 54 is disposed next to the first path 53. The check valve 54 is screwed into the housing 41, so that a delivery pipe 55 communicates with an oil transfer pump (not shown) for transferring light oil as the auxiliary fuel. A second path 56 is formed at the other end of the cylinder 42. A check valve 57 is disposed next to the second path 56. The check valve 57 is fixed by a nut 58 in the housing 41. A delivery pipe 59 is connected to a fuel injection nozzle so as to deliver light oil delivered through the check valve 57.

When pressurized alcohol is delivered to the inlet port 43, the piston 45 is moved against the urging force of the spring 47 so as to deliver light oil previously supplied in the cylinder 42 and to the delivery pipe 59 through the check valve 57. In this case, the delivered quantity of light oil is determined by the stroke of the piston 45.

Figure 6:
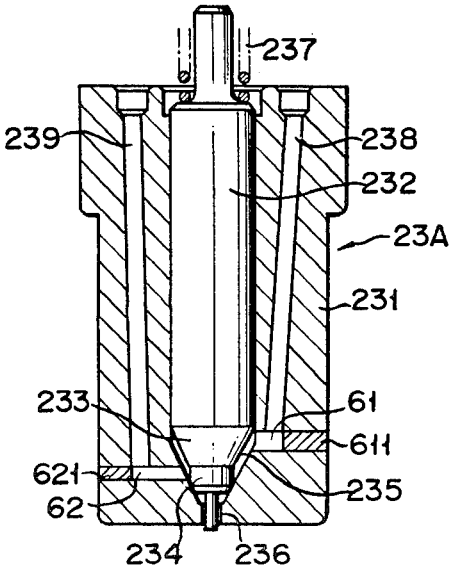
FIG. 6 is a sectional view of a fuel injection nozzle according to a third embodiment of the present invention.

FIG. 6 shows a fuel injection nozzle 23 according to a third embodiment of the present invention. The fuel injection nozzle has a nozzle needle 232 in a nozzle housing 231 and a fuel reservoir 235 in the vicinity of a fuel injection port 236, in the same manner as in the fuel injection nozzle shown in FIG. 2. Through holes 61 and 62 are formed extending from the side walls of the housing 231 so as to communicate with the fuel reservoir 235. First and second passages 238 and 239 communicate with the through holes 61 and 62, respectively. Stops 611 and 621 are fitted in the through holes 61 and 62 through the openings, respectively. The fuel injection nozzle having the above construction can be easily manufactured.

Figure 7A:
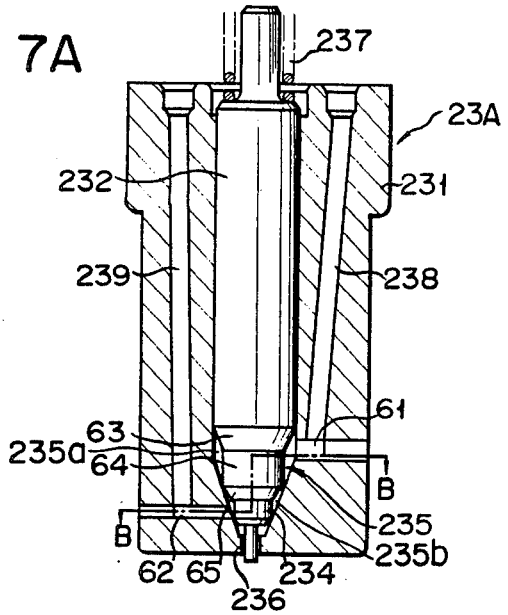
FIG. 7A is a sectional view of a fuel injection nozzle according to a fourth embodiment of the present invention.
Figure 7B:
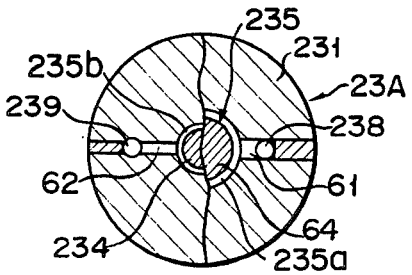
FIG. 7B is a sectional view of the fuel injection nozzle in FIG. 7A taken along the line B—B.

FIGS. 7A and 7B show a fuel injection nozzle according to a fourth embodiment of the present invention. This fuel injection nozzle has a structure such that the distal end portion thereof is formed integrally with an intermediate-diameter portion 64 through a first tapered portion 63, and the intermediate-diameter portion 64 is formed integrally with a seat 234 through a stepped portion which includes a second tapered portion 65. When the seat 234 is positioned to close the fuel injection port 236, the second tapered portion 65 is brought adjacent to the wall surface of the fuel reservoir 235. The fuel reservoir 235 is thus divided into first chamber 235*a* and second chamber 235*b*. The hole 61 which communicates with the first passage 238 is open to the first chamber 235*a*, and the hole 62 which communicates with the second passage 239 is open to the second chamber 235*b*.

Figure 8:
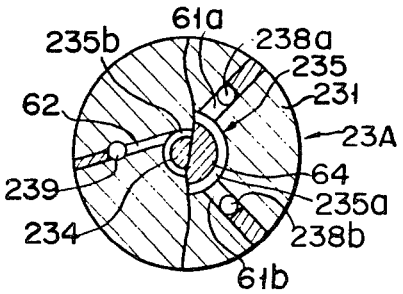
FIG. 8 is a sectional view of a modification showing a fuel injection nozzle different from FIG. 7B, that shown in FIG. 7A taken along a line corresponding to the line B—B.

The holes 61 and 62 which are open to the fuel reservoir 235 are formed running toward the central axis of the nozzle needle 232. However, the hole 62 which communicates with the second passage 239 in the vicinity of the seat 234 so as to fill light oil therein may extend tangentially to the surface defining the fuel reservoir 235, as shown in FIG. 8. In this case, pressurized light oil within the fuel reservoir 235 may not cause turbulence. In other words, light oil is properly separated from alcohol and is filled in the fuel reservoir 235.

The first passage for delivering alcohol need not be a single passage. As shown in FIG. 8, a plurality of first passages 238*a*, 238*b*, . . . may be formed around the first chamber 235*a* of the fuel reservoir 235 so as to deliver alcohol through holes 61*a*, 61*b*, . . . , respectively. The pressure of the alcohol is then uniformly distributed in the fuel reservoir 235. As a result, light oil may not be mixed with alcohol; light oil is first injected and then alcohol is injected.

In the above embodiments, alcohol is used as the main fuel, and light oil is used as the auxiliary fuel having good ignitibility as compared with that of the main fuel. However, a combination of eucalyptus oil or the like as the main fuel and another type of fuel having good ignitibility may also be used.

Furthermore, in order to achieve good ignition of fuel, light oil may be used as the main fuel stored in the main tank 10 (FIG. 1) and water may be used and stored in the auxiliary tank 11 (FIG. 1). In this case, water is first injected from the fuel injection nozzles 23A to 23D and light oil is then injected therefrom so as to form a two-layer structure of light oil and water, thereby effectively decreasing the combustion temperature in the combustion chamber and hence obtaining an anti-pollution internal combustion engine.

What we claim is:

1. A fuel injection apparatus for an internal combustion engine, for injecting different types of fuel into a combustion chamber of a cylinder in a given order, comprising:

(a) a nozzle housing having a fuel injection port and a needle valve disposed within said nozzle housing and movable along an axis thereof, said needle valve being tapered toward a distan end, which distal end is adapted to contact a correspondingly shaped portion of said nozzle housing to form a seat portion which closes the fuel injection port of the nozzle housing;

(b) resilient means for urging the needle valve in such a direction that said seat closes the fuel injection port of the nozzle housing;

(c) a fuel reservoir above and adjacent the seat portion and further extending upstream of said seat portion between an inner periphery of said nozzle housing and an outer periphery of said needle valve;

(d) a first fuel passage defined in the nozzle housing and opening at one end into said reservoir in a position remote from said seat for supplying a pressurized main fuel;

(e) a second fuel passage defined in the nozzle housing and opening at one end into said reservoir in a position close to said seat for supplying an auxiliary fuel to be used together with the main fuel;

(f) auxiliary fuel delivering means for delivering a specified amount of the auxiliary fuel through said second fuel passage to said fuel reservoir; and (g) fuel compressing/delivering means for delivering pressurized main fuel through said first fuel passage to said fuel reservoir filled with the auxiliary fuel, to thereby move said needle valve against and urging force applied on said needle valve so as to move said seat from said fuel injection port and thus to inject the main and auxiliary liquid fuel through said fuel injection port.

2. An apparatus according to claim 1, wherein those portions of said first and second fuel passages which open to said fuel reservoir extend parallel to each other and are separated by said fuel reservoir.

3. An apparatus according to claim 1, wherein each of said plurality of compressors has a path for filling the pressurized auxiliary fuel therein, a cylinder communicating with said path, and a piston fitted in said cylinder, whereby a pressure of the pressurized main fuel delivered from another fuel injection nozzle different from said fuel injection nozzle which receives the auxiliary fuel from a corresponding one of said compressors is applied to said piston, thereby discharging the auxiliary fuel from said path.

4. An apparatus according to claim 3, wherein a check valve is provided at an inlet port of said path for filling the auxiliary fuel delivered from said corresponding one of said compressors, and another check valve is provided at an output port of said path so as to discharge the auxiliary fuel pressurized by said piston.

5. An apparatus according to claim 3, wherein said piston driven by the pressure of the main fuel has a stroke corresponding to an injection quantity of the auxiliary fuel for each injection.

6. An apparatus according to claim 1, wherein said nozzle needle has a stepped portion which is adjacent to an inner surface of said housing which defines said fuel reservoir while said nozzle needle closes said fuel injection port, said fuel reservoir being divided by said stepped portion into two chambers arranged next to each other along an axial direction of said nozzle needle.

7. An apparatus according to claim 6, wherein said second passage is open to one of said two chambers which is adjacent to said fuel injection port, and said first passage is open to the other of said two chambers which is spaced apart from said fuel injection port.

8. An apparatus according to claim 1, wherein said second passage is open to the portion of said fuel resevoir which is adjacent to said fuel injection port and has an axis which is tangential to an outer circumferential surface of said nozzle needle.

9. An apparatus according to claim 1, wherein said housing has a plurality of openings which surround said nozzle needle at positions spaced apart from said fuel injection port, said plurality of openings communicating with said first passage.

10. A fuel injection apparatus for an internal combustion engine arranged so as to inject different types of fuel into a combustion chamber of a cylinder in a given order, comprising:

fuel injection nozzle means disposed adjacent to a fuel injection port of a distal end portion of a nozzle needle, said fuel injection nozzle means having a fuel reservoir which is defined in a housing to surround said nozzle needle and to communicate with said fuel injection port;

auxiliary fuel delivering means for filling, said fuel reservoir of said fuel injection nozzle means with an auxiliary fuel used together with a main fuel, from a portion adjacent to said fuel injection port; and main fuel compressing/delivering means for delivering pressurized main fuel to said fuel reservoir filled with the auxiliary fuel in accordance with a predetermined injection timing so as to open said nozzle needle, thereby injecting first the auxiliary fuel and subsequently the main fuel, wherein said fuel injection nozzle means comprises a plurality of fuel injection nozzles respectively corresponding to a plurality of said cylinders of said internal combustion engine, said auxiliary fuel delivering means comprises a plurality of compressors respectively corresponding to said plurality of fuel injection nozzles, and said main fuel compressing/delivering means comprises a main fuel injection pump for injection the main fuel to said plurality of fuel injection nozzles at respective injection timings, wherein each of said plurality of compressors has a path for filling the pressurized auxiliary fuel therein, a cylinder communicating with said path, and a piston fitted in said cylinder, whereby a pressure of the pressurized main fuel delivered from another fuel injection nozzle different form said fuel injection nozzle which receives the auxiliary fuel from a corresponding one of said compressor is applied to said piston, thereby discharging the auxiliary fuel from said path.

11. An apparatus according to claim 10, wherein a check valve is provided at an inlet port of said path for filling the auxiliary fuel delivered from said corresponding one of said compressors, and another check valve is provided at an output port of said path so as to discharge the auxiliary fuel pressurized by said piston.

12. An apparatus according to claim 10, wherein said piston driven by the pressure of the main fuel has a stroke corresponding to an injection quantity of the auxiliary fuel for each injection.

* * * * *